United States Patent [19]

Hayashi

[11] 4,207,798

[45] Jun. 17, 1980

[54] GAS OPERATING SYSTEM FOR LOADING SHOT SHELL IN AN AUTOMATIC GUN

[75] Inventor: Hisao Hayashi, Tokyo, Japan

[73] Assignee: Kabushiki Kaisha Kawaguchiya Hayashi Juho Kayaku-Ten, Tokyo, Japan

[21] Appl. No.: 850,202

[22] Filed: Nov. 10, 1977

[30] Foreign Application Priority Data

| | | | |
|---|---|---|---|
| Nov. 16, 1976 | [JP] | Japan | 51-137581 |
| Dec. 29, 1976 | [JP] | Japan | 51-159849 |
| Dec. 29, 1976 | [JP] | Japan | 51-177680[U] |

[51] Int. Cl.[2] ..... F41D 5/10

[52] U.S. Cl. ..... 89/191 R; 42/75 B

[58] Field of Search ..... 89/191 R

[56] References Cited

U.S. PATENT DOCUMENTS

| | | | |
|---|---|---|---|
| 2,805,606 | 9/1957 | Harvey | 89/191 R |
| 3,166,983 | 1/1965 | Lizza | 89/191 |
| 3,246,567 | 4/1966 | Miller | 89/191 R |

*Primary Examiner*—Stephen C. Bentley

*Attorney, Agent, or Firm*—Toren, McGeady and Stanger

[57] ABSTRACT

In an automatic gun, the gas pressure generated by the firing of a shot shell is transmitted to the breechblock in the receiver housing by the axial sliding movement of an action bar assembly mounted outside the gunbarrel or the cartridge magazing tube for releasing the breechblock. The action bar assembly includes action bars slidably mounted coaxially with each other and an adjusting spring for arresting the contraction of the span between the stem bodies. A cylinder is fixed to the gunbarrel for receiving the gas pressure from it. The forward end of the action bar assembly extends into the cylinder, while the rearward end passes through a guide hole in the receiver into contact with the front surface of the breechblock. The rearward end has a stopper for restricting the axial movement of the action bar assembly to a predetermined length. A supporting mechanism serves to arrest the rotation of the gunbarrel and the fore-arm by engaging a projection of a predetermined shape, provided at the forward end of the receiver, with cutout portions in the outer periphery of the gunbarrel and the fore-arm.

2 Claims, 10 Drawing Figures

GAS OPERATING SYSTEM FOR LOADING SHOT SHELL IN AN AUTOMATIC GUN

BACKGROUND OF THE INVENTION

The present invention relates to a gas operating device for releasing the locking of the breechblock by axially moving the action bar assembly mounted outside of the gunbarrel or the cartridge magazine tube located in juxtaposed relationship to the gunbarrel by utilizing the gas pressure generated at the firing of the shot shell in an automatic gun and succeedingly for causing recoiling the breechblock, and to a supporting mechanism for the gunbarrel and the fore-arm.

Many of the prior art automatic guns are of the type wherein the empty cartridge is extracted by the recoiling of the breechblock caused by utilizing the gas pressure generated at the firing of a shot shell and a new shot shell is loaded. However, the breechblock also exhibits the action to block the barrel extension of the gunbarrel, and the above described blocking state must be maintained until the gun powder is brought to its normal explosion condition after ignition thereof. To this end, the gun is so constructed that the movable body is displaced by the above described gas operating device by the medium of the gas pressure at a predetermined position of the gunbarrel so that the locking of the breechblock is released by the sliding movement of the action bar assembly and succeedingly the recoiling of the breechblock is effected at a predetermined time delay of the action.

Many of the gas operation devices provided in the prior art automatic guns of the type described above are so constructed that the cylinder housing therein a piston actuated by the gas pressure introduced therein from the gunbarrel is arranged at the front end portion of the cartridge magazine tube so that the sliding movement of the piston is transmitted to the breechblock through cylindrical action sleeve slidingly engaging with the cartridge magazine tube and thence through action bar integral with or arranged separately from the action sleeve.

However, the gas operating device constructed as described above has the following disadvantages:

When the action bar mounted integrally with the periphery of the action sleeve transmits the impact load from the piston acting against the action sleeve, a bending amount is given to the action bar so that the periphery of the action sleeve might rub the sliding surface of the cartridge magazine tube. Therefore, in order to withstand such actions, the action bar and the action sleeve must be made of a high strength material.

Further, when the action sleeve and the action bar are manufactured as separate members and they are joined together thereafter, the directions of force applied thereto are different from each other, so that it is necessary to maintain sufficient strength at the connecting portion thereof.

Further, in the gas operating device of the kind as described above, since the bottom portion of the receiver or the guide hole of the breechblock might be damaged or broken when unnecessarily large recoiling force is given to the breechblock by giving to the breechblock a sufficient force for automatically loading a shot shell to rearwardly move the same in the receiver and succeedingly forwardly advance the same for completing a series of operations (referred to hereinafter as "OPERATION"), the cylinder is so constructed that the gas is freed from the cylinder when the piston has been rearwardly moved a predetermined length. However, in case the gas pressure of the shot shell used is low, it might occur that a sufficient rotation is not given to the breechblock.

Further, the gas pressure generated at the firing of a shot shell differs largely depending upon the kind of the shot shell usually used, so that the delay in actuation of the movable body in response to the variation in the load acting thereagainst will become irregular or uneven. Thus, it is very difficult to insure a constant delay time of actuation of the action bar assembly by compensating for the gas pressure varying in a wide range.

The prior art gunbarrel supporting mechanism provided in an automatic gun is of the construction wherein the rearward end portion of the gunbarrel is inserted into an opening in the front end portion of the receiver housing therein the mechanism of the breechblock assembly by a predetermined length and either one the portion of the gunbarrel inserted into the receiver and the inner wall surface of the receiver is provided with a projection while a recess is formed in the other so that the engagement of the projection and the recess serves as the rotation arresting means, the bracket provided in the tip of the gunbarrel being attached to the cartridge magazine thereby preventing removal of the gunbarrel. Thus, the fore-end or fore-arm arranged outside of the gunbarrel and embracingly supporting the cartridge magazine is usually so configured that the ends of the both arms of the forward stock in the substantially U-shape in cross-section abut against the outer periphery of the gunbarrel along the generating line of the gunbarrel, and the rearward end portion of the fore-arm embracingly supports the side edge portion of the receiver so as to serve as the rotation arresting means, the removal of the fore-arm being effected at the forward end portion of the cartridge magazine barrel as in the case of the gunbarrel.

However, in the construction as described above, since the gunbarrel is supported in rotation preventing manner, a pair of projection-recess engaging portion must be formed in the gunbarrel and the inner wall of the receiver, thereby requiring a separate rotation preventing portion to be formed for the fore-arm. Thus, the machining operation is increased and the configuration of the rearward end portion of the fore-arm is limited because the rearward end portion must embrace the side surfaces of the receiver thereby restricting the freedom of design of the construction.

SUMMARY OF THE INVENTION

The object of the present invention is to provide a gas operating device which avoids the shortcomings inherent to the prior art gas operating device and which can apply appropriate force for displacing the breechblock in response to the variation in the gas pressure thereby permitting without hindrance the extraction of the empty cartridge, and automatic charging of a new cartridge and still the force is applied to the action bar assembly solely in the axial direction thereby remarkably reducing requirement for the strength of the elements of the gas actuated device.

The gas operating device for loading a shot shell in an automatic gun constructed in accordance with the present invention is so constructed that the movable body, namely action bar assembly is constituted by stem bodies I, II axially slidably engaged with each other and an adjusting spring arresting the contraction of the span between the stem bodies I, II by a predetermined spring force so that when a relatively low gas pressure is loaded onto the movable body so that the load of the gas pressure actuates the action bar assembly the adjusting spring is hardly deformed but transmits the movement of one of the stem bodies I, II to the other, while, on the other hand, when a relatively large gas pressure is loaded onto the action bar assembly, the adjusting spring is deformed largely so that the transmission of the displacing force is delayed. In the above described construction of the gas operating device, no gas freeing mechanism of the prior art gas operating device for regulating the variation in the gas pressure is required, i.e. the mechanism is not required in which the interior of the cylinder is rendered to communicate with the atmosphere so as to relieve the excessive load when the action bar assembly or the piston engaging slidably with the cylinder is moved a predetermined length of stroke with respect to the cylinder in which the gas pressure is introduced from the gunbarrel. Therefore the amount of the gas introduced into the cylinder is remarkably reduced thereby permitting the superior effect for preventing the contamination of the device can be insured. Further, in the gas operating device of the present invention described above, since the action bar assembly is so constructed by the action bars I, II that they are relatively axially movable to each other in coaxial relationship, the requirement in the rigidity and strength of each elements can be reduced by the aid of the flexibility of the adjusting spring.

The other construction serving as the gas operating device of an automatic gun for loading a shot shell constructed in accordance with the present invention is different from the construction of the prior art device having the cylinder at the front end portion of the cartridge magazine, and is so constructed that the cylinder is juxtaposed to the cartridge magazine with the front end portion of the rod-like movable action bar assembly slidably received in the cylinder so as to extend in the direction of the generating line of the gunbarrel, while the rearward end portion of the action bar assembly passes through the guide hole of the receiver axially movable so as to be positioned at the front surface of the breechblock, a stopper being provided which restricts the axial movement of the action bar assembly to a predetermined distance.

The other object of the present invention is to provide a supporting mechanism which avoids the disadvantages of the prior art supporting mechanism for the gunbarrel and the fore-arm described above and which enables the gunbarrel and the fore-arm to be prevented from rotation simultaneously.

In other words, a projection is provided at the front end surface of the receiver and a cutout portion is formed in the rearward end edge each of the gunbarrel and the fore-arm which engages with the projection, and the effect for preventing the rotation of the gunbarrel and the fore-arm in the circumferential direction is provided by the engagement of the above described projection and the cutout portion.

BRIEF DESCRIPTION OF THE DRAWINGS

FIG. 1 showing the arrangement of the elements constituting the gas operation device in its non-operated state, while FIG. 2 shows the arrangement in its operated state;

FIGS. 5 and 6 are side views partly in cross-section showing another embodiment of the automatic gun provided with the gas operation device constructed in accordance with the present invention, FIG. 5 showing the arrangement of the elements constituting the gas operation device in its non-operated state, while FIG. 6 shows the arrangement in its operated state;

DESCRIPTION OF THE PREFERRED EMBODIMENTS

Figure 1:
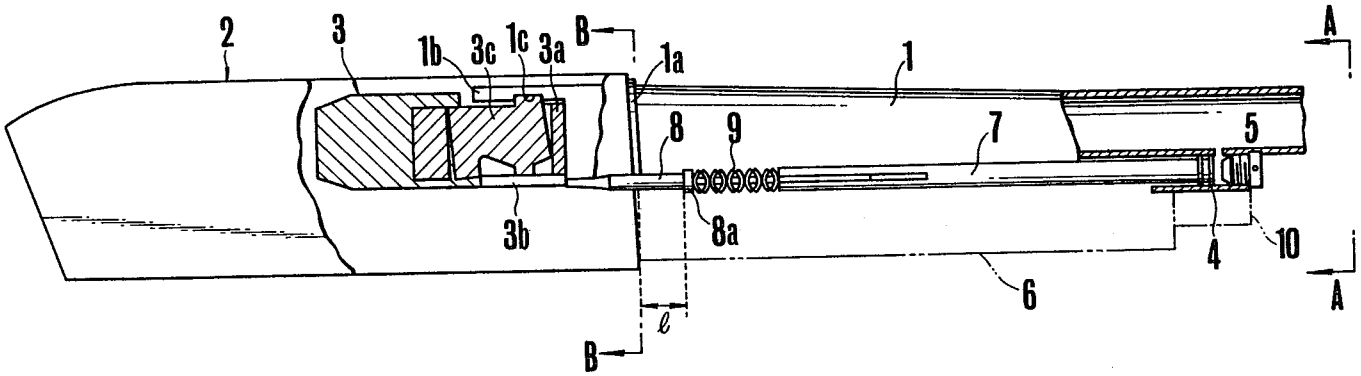
FIGS. 1 and 2 are side views partly in cross-section showing an embodiment of the automatic gun provided with the gas operation device constructed in accordance with the present invention.
Figure 2:
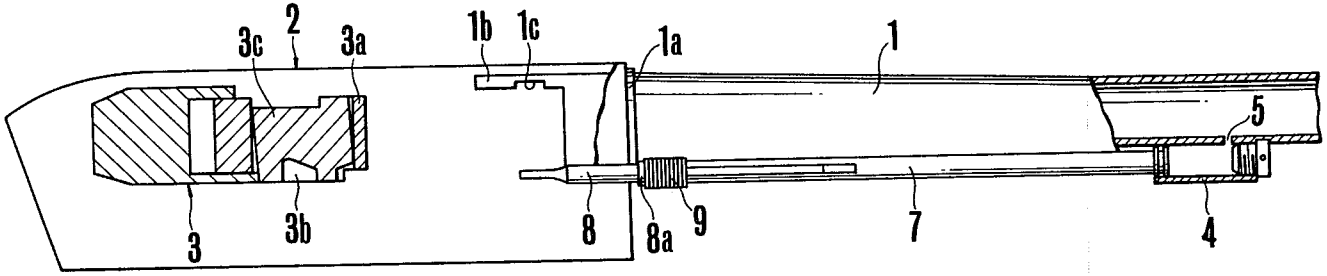

The details of the gas operation device of an automatic gun for loading a shot shell and the supporting mechanism for the gunbarrel and the fore-arm constructed in accordance with the present invention will be described hereinbelow with reference to the embodiments illustrated in the accompanying drawings.

In the embodiment shown in FIGS. 1 to 4, the reference numeral (1) designates the gunbarrel, (2) the receiver housing to which the gunbarrel (1) is fixedly secured, (3) the breechblock, while (4) designates the cylinder, respectively. The cylinder (4) is fixedly secured to the gunbarrel (1) at the predetermined position thereof and communicates with the interior of the gunbarrel (1) through a gas hole (5). The reference numeral (6) designates the cartridge magazine which is fixedly secured to the gunbarrel (1) separately from the cylinder (4) in juxtaposed relationship thereto. The reference numerals (7), (8) designate the action bars I, II which are axially movable relatively to each other in sliding relationship, one action bar I (7) of the two being slidingly received at its forward end portion into the cylinder (4) while the rearward end portion of the other action bar II (8) passes through a guide hole (2a) drilled in the receiver housing (2) so as to abut against the front surface of the breechblock (3). The above described positional relationship may be the abutting relationship or may be the relationship in which a predetermined distance is provided therebetween. It is only the cylinder (4) and the guide hole **(2*a*) of the receiver housing (2) that supports the action bars I, II, (7), (8) slidingly engaging with each other and guides the axial displacement of the action bars. The reference numeral (9) designates the adjusting spring which is surrounded by the action bar II (8), and the respective ends of the adjusting spring are engaged with the rearward end of the action bar I (7) and the flange portion (8*a*) of the action bar II (8), respectively. The breechblock (3) is constituted by an upper body (3*a*), a lower slider (3*b*) and a locking block (3*c*), and, when the slider (3*b*) is rearwardly moved relative to the upper body (3*a*) by a predetermined length by the urging force of the action bar II (8)**

abutting against the front surface of the slider (3*b*), the engagement of the locking block (3*c*) with the opening (1*c*) of the extension (1*b*) of the gunbarrel (1) is released, so that the rearward movement of the entire assembly of the breechblock is commenced. The reference numeral (10) designates a bracket, which serves to securely fix the tip portion of the cartridge magazine (6) to the gunbarrel (1), the reference numeral (2*b*) designating the opening of the receiver housing (2) in which the gunbarrel (1) is fitted, while the reference numeral (2*c*) designates the opening in which the cartridge magazine (6) is fitted.

Now, the sequence of the operation of the embodiment of the gas operation device thus far described will be described. In the non-operated state of the device shown in FIG. 1, the breechblock (3) is locked to the gunbarrel (1) so as to block the bottom portion of the breechblock (3). The action bar assembly constituted by the action bars I, II (7), (8) and the adjusting spring (9) is held stationarily at the position shown in FIG. 1, at which position the spring (9) is subjected to no compressive load.

It is practically advantageous to design the flange (8*a*) of the action bar II (8) that it abuts against the stepped portion (1*a*) of the gunbarrel (1) or against the receiver housing (2) when the action bar II (8) is displaced by a predetermined rearward stroke of the length l thereby preventing the action bar II (8) from further moving rearwardly.

When a shot shell is fired by the gun in the above described condition of the arrangement, the gas pressure is introduced into the interior of the cylinder (4) after the wad (not shown) has passed through the gas hole (5) in the gunbarrel (1). Thus, an impact load will act against the tip portion of the action bar I (7), so that the rearward movement of the action bar I (7) commences. This impact force is transmitted to the action bar II (8) through the adjusting spring (9), wherein the impact force is transmitted to the action bar II (8) while the adjusting spring (9) is deformed by a predetermined amount depending upon the resisting force by which the action bar II (8) is arrested by the breechblock (3) and the elastic coefficient of the adjusting spring (9) and the amount of the impact load described above and succeedingly, the slider (3*b*) of the breechblock (3) is caused to move rearwardly. When the slider (3*b*) is moved rearwardly to same extent, the locking of the upper body (3*a*) is released so that the rearward movement of the entire assembly of the breechblock (3) commences. The springing extracton of the empty cartridge and the automatic loading of the new cartridge effected after the above described sequence of operation are carried out in the similar manner as in the case of the well known device.

The above described series of operations are effected within a very short time period, but the time delay of the operation until the breechblock (3) commences the rearward movement is compensated for by virtue of the deformation of the adjusting spring (9) even though the gas pressure generated by the burning of the gun powder of the shot shell varies greater or smaller thereby permitting the amount of the time delay to be maintained at a substantially constant value. According to the results obtained by the experiments carried out in accordance with the present invention, the gas operation device as shown with reference to the embodiment thus far described exhibits superior actuations for all of the cartridges available in the markets adapted to be used in the automatic shot guns, thus proving the function for automatic loading of a shot shell to be sufficiently carried out. Further, by virtue of the construction of the above described embodiment, it is not necessary to make the length of the sliding movement between the action bar I (7) and the cylinder (4) too large by restricting the amount of the stroke of the entire assembly of the action bar assembly insofar as the action bar II (8) is arrested by the gunbarrel (1) and other member after it has moved rearwardly by a predetermined distance, thereby affording advantages in the machining thereof, and, further, the load applied by the action bar I (7) after the arresting of the action bar II (8) is absorbed by the adjusting spring (9) thereby rendering the influence given to the respective elements of the device to be relatively small.

In addition to the above described effectiveness, it is not necessary to provide a gas exhausting mechanism at a portion of the cylinder (4), the amount of the burnt gas introduced into the cylinder (4) being remarkably reduced in comparison with the device provided with the prior art mechanism thereby reducing the danger of erroneous functions which might occur by the excessive contamination of the cylinder (4) causing the failure of the device, while the damage to the operator by the burning gas ejected from the device is positively avoided. Further, the necessity of taking into consideration of the bending moment of the action bars I, II (7), (8) constituting the action bar assembly is positivey avoided thereby permitting the requirement for the rigidity and the strength of the elements constituting the device to be eased so that the manufacturing cost is lowered while the durability of the device is improved.

The adjusting spring may be constituted by combining various kinds of dish-shaped springs having different coefficient of elasticity. In this case, the deformation of the springs occurs beginning at the dish-shaped spring having the smaller coefficient of elasticity.

Now, the other embodiment of the gas actuated device for automatically loading a shot shell will be described with reference to FIGS. 5 and 6 which the similar parts to those shown in FIGS. 1 to 4 are designated by the same reference numerals given in those figures.

Figure 3:
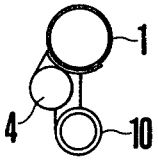
FIG. 3 is a cross-sectional view taken along line A—A in FIG. 1.
Figure 4:
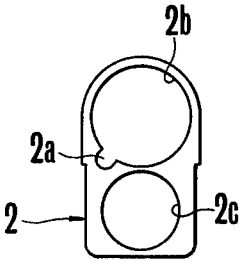
FIG. 4 is a cross-sectional view taken along line B—B in FIG. 1.
Figure 5:
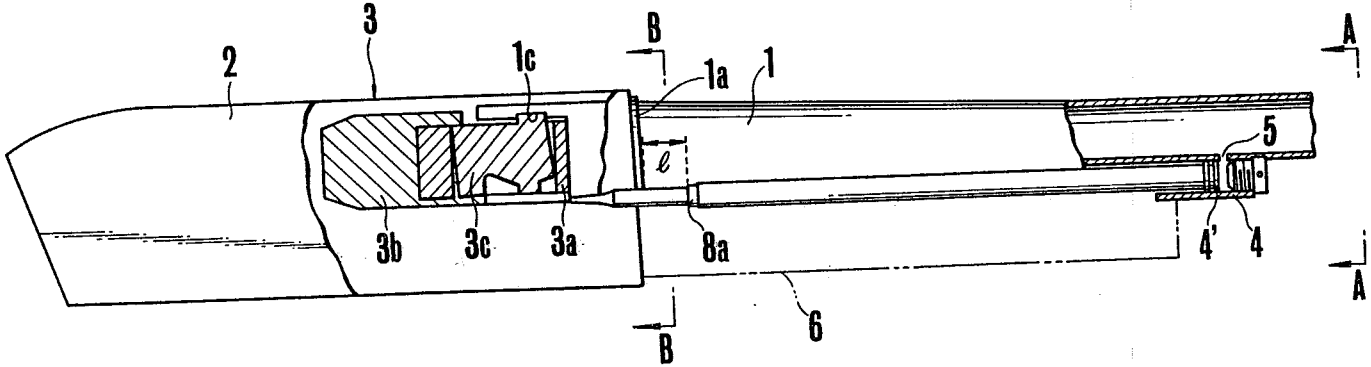
Figure 6:
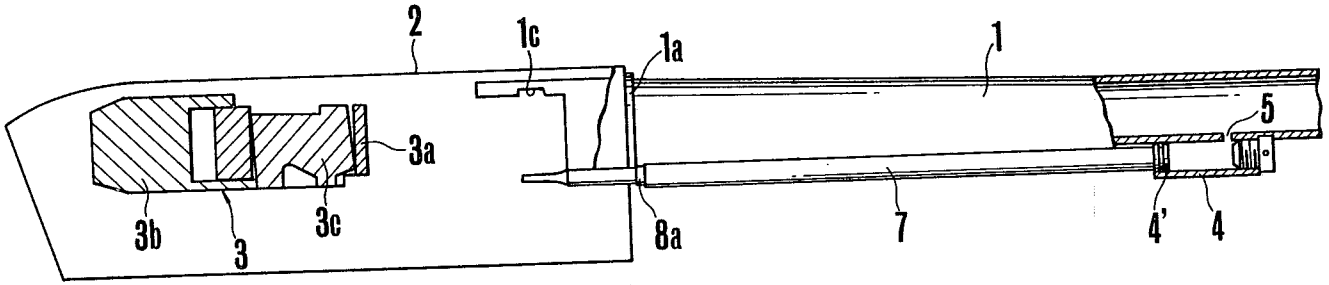
Figure 7:
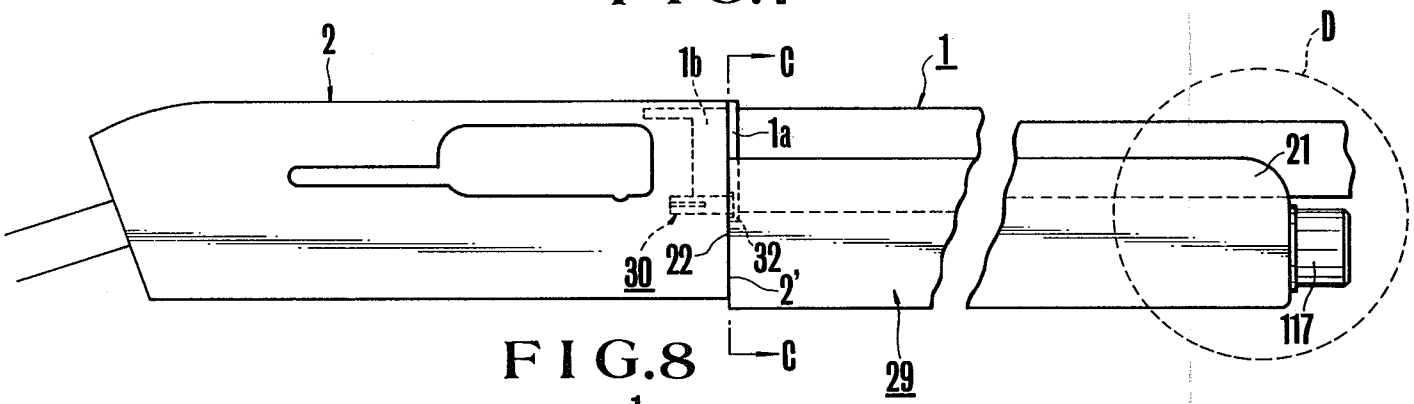
FIG. 7 is a side view showing an embodiment of the automatic gun provided with a supporting mechanism for the gun-barrel and the fore-arm constructed in accordance with the present invention.

In FIGS. 5 and 6 (with reference to FIGS. 3 and 4 illustrating the previously described embodiment), the reference numeral (1) designates the gunbarrel, (2) the receiver housing, (3) the breechblock assembly, respectively, and the breechblock (3) comprises in combination the breechblock piece (3*a*) and the breechblock slider (3*b*) which are relatively movable to each other, and the locking block (3*c*) is freely insertable into and retractable from the opening in the breechblock slider (3*b*). The reference numeral (2*b*) designates the engaging hole for the gunbarrel (1) opening in the front end of the receiver housing (2) (refer to FIGS. 3 and 4), (2*c*) the engaging hole for the cartridge magazine (6), while the reference (2*a*) designates the guide hole for the action bar (7), respectively. The reference number (4) designates the cylinder fixedly secured to the gunbarrel (1) at about the central portion thereof in the axial direction and the cylinder (4) communicates with the interior of the gunbarrel (1) through the gas hole (5). A piston ring (4') is secured to the front end of the enlarged diameter portion of the stepwise configured action bar (7) and it slidably engages with the cylinder (4) while the rearward end of the reduced diameter portion thereof passes through the guide hole (2*a*) of the receiver housing (2) axially movably thereto so that it is positioned at the front surface of the breechblock slider (3*b*) included in the breechblock (3) held in the stationary state as shown in FIG. 5. The stepped shoulder portion (8*a*) of the action bar (7) is so configured as to be engageable with the flange portion (1*a*) of the gunbarrel (1). In other words, the flange portion (1*a*) of the gunbarrel (1) serves as the stopper restricting the axial displacement of the action bar (7) to the predetermined length l as shown in FIG. 5. The reference numeral (10) designates the fixing bracket for securing the cartridge magazine (6) to be fixedly secured to the gunbarrel (1), and the cartridge magazine (6) is secured to the gunbarrel in juxtaposed relationship to the cylinder (4) independently therefrom.

Now, the sequence of operations of the above described embodiment will be described prior to the shooting of a shot shell, the action bar (which is constructed integrally) (7) is urged against the breechblock slider (3*b*) of the breechblock assembly (3) so as to be positioned at the position shown in FIG. 5, while the breechblock assembly (3) is locked so that the breechblock (3*a*) blocks the abutting surface of the gunbarrel (1) against the breechblock assembly (3) with the locking block (3*c*) being in engagement with the recess (1*c*) of the gunbarrel (1).

When the shot shell is fired, the gas pressure of the predetermined value is introduced into the cylinder (4) so that the action bar (7) is moved rearwardly by the urging force of the gas pressure. Thus, the rearward end portion of the action bar (7) causes the rearward movement of the breechblock slider (3*b*) and, when the rearward stroke thereof exceeds a predetermined amount, the locking by the locking block (3*c*) is released so that the rearward movement of the entire assembly of the breechblock assembly (3) is effected. On the other hand, the action bar (7) is restricted its rearward movement by the engagement of the stepped shoulder portion (8*a*) thereof with the flange portion (1*a*) of the gunbarrel (1) so that it is stopped at the position shown in FIG. 6. When the breechblock assembly (3) moves forwardly, the action bar (7) is restored to its initial position.

In the sequence of operations as described above, when the value of the gas pressure introduced into the cylinder (4) is large, the breechblock assembly (3) might collide against the rearward bottom portion of the receiver housing (2) so that it be damaged and, therefore, the enlarged diameter portion of the action bar (7) is made large in length while the reduced diameter portion thereof is made short in length, thereby permitting the rearwardly urging force given to the breechblock assembly (3) to be reduced.

By the constructon described above, the construction is reduced to be far simpler than the prior art gas operating device of the kind described above, and the action bar (7) can be easily interchanged when the gunbarrel (1) is removed from the receiver housing (2), and proper rotational operation of the breechblock can be insured by using an action bar which is appropriately adjusted in its axial displacement for various shot shell having different gas pressure characteristics, hereby broadening the range of application of the automatic guns.

As is clear from the construction as shown in the drawings, the element of the gas operating device except the breechblock assembly (3) comprises an integrally formed rod-like construction forming the action bar, and no bending moment is given thereto in the operation of the gas operating device, and, therefore, it is free from the limitation of the material, the strength and the like and the freedom in design is widened.

Further, the means for restricting the axial displacement of the action bar to a predetermined distance is so constructed that a sleeve is threadedly secured to the guide hole of the receiver housing and the action bar is passed through the sleeve so as to arrest the stepped shoulder portion of the action bar by the front end surface of the sleeve. This construction permits the position of arresting to be steplessly adjusted easily by merely adjusting the rotation of the threadedly engaged sleeve.

Now, the supporting mechanism for arresting the rotation of the gunbarrel and the forearm will be described with reference to FIGS. 7 to 10 showing are embodiment thereof.

In the drawings, the reference numeral (1) designates the gunbarrel, (2) designates the receiver, while (2') designates the front end surface thereof the barrel extension (1*b*) of the gunbarrel (1) is inserted through an opening (not shown) in the front end surface (2') of the receiver (2) to a position until the flange (1*a*) of the gunbarrel (1) abuts against the front end surface (2') of the receiver (2). The reference numeral (6) designates the cartridge magazine tube secured to the receiver (2) so as to extend from the front end surface (2') forwardly, and the action bar (7) having the stepped threaded portion (8') is secured to the front end portion of the cartridge magazine tube (6). The reference numeral (29) designates the fore-arm in the substantially U-shape in cross-section, the respective tips of the arms (20), (21) of which abut against the outer periphery of the gunbarrel (1) along the generating line thereof while the rearward end surface (22) abuts against the front end surface (2') of the receiver (2). The reference numeral (113) designates the projection formed adjacent to the central portion of the gunbarrel (1) and extending radially therefrom. A throughhole (114) having a axis in parallel to the axis of the gunbarrel (1) is formed in the projection (113).

The reference numeral (115) designates the partition of the fore-arms (29) at the forward end thereof, and a throughhole (116) is formed in the partition (115) which allows the stepped stem (7) attached to the forward end of the cartridge magazine tube (6) to be passed therethrough. The reference numeral (117) designates the magazine cap, (118) designates the dish-shaped springs, while (119) designates the sleeve, respectively. The reference numeral (30) designates the pin which is fitted in the throughhole (31) formed in the front end surface (2') of the receiver (2). The head (32) of the pin (31) projects from the front end surface (2'). The reference numeral (33) designates the cutout portion formed in the flange (1*a*) of the gunbarrel (1), while (34) designates the cutout portion formed in the rearward end surface (22) of the fore-arm (29).

In the construction of the gunbarrel supporting mechanism as described above, rotation arresting action is effected by the flange (1*a*) abutting against the forward end surface (2') of the receiver (2) and the projection (113) fitting with the action bar (7) secured to the cartridge magazine tube (6), and, further, the rotation preventing effect is given at the front end of the gunbarrel (1). Further, the rotation preventing action is obtained by the engagement of the head (32) of the pin (30) with the cut-out portion (33) formed in the flange (1*a*), thereby positively insuring the proper support of the gunbarrel without any loosening.

Since dish-shaped springs (118) are arranged at a position at which the action bar (7) and the nut (117) serving to prevent the withdrawal of the projection (113) of the gunbarrel (1) are interposed, and loosening is positively prevented during the use of the gun even though this device is used in an automatic gun which generates very severe vibration during the shooting.

As to the supporting mechanism for the fore-arm (29), the fore-arm (29) is prevented from rotating due to the fact that the respective tips of the arms (20), (21) abut against the gunbarrel (1) and the action bar (7) is fitted in the throughhole (116) of the partition (115) at the forward end of the fore-arm (29). Further, the withdrawal preventing action of the dish-shaped spring (118) and the nut (117) assists the prevention of the loosening. Since the rearward end of the fore-arm (29) is subjected to the rotation preventing action by virtue of the engagement of the head (32) of the pin (30) with the cutout portion (34) in the rearward end surface (22) of the fore-arm (29), it is not necessary to make the configuration of the fore-arm (29) in the shape embracing the sides of the receiver (2) as is required in the prior art device.

Figure 8:
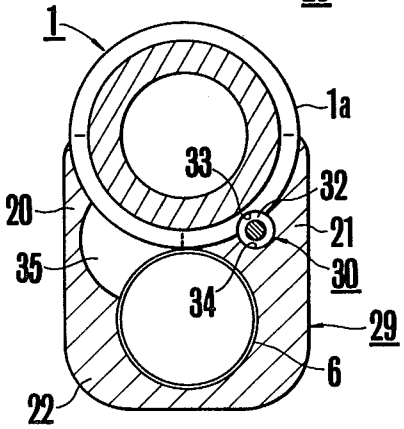
FIG. 8 is a cross-sectional view along line C—C in FIG. 7.
Figure 9:
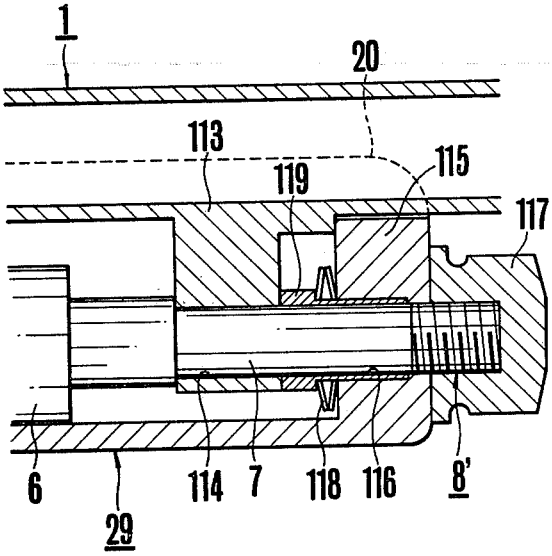
FIG. 9 is a fragmentary longitudinal sectional view in enlarged scale showing the portion encircled by the broken line D in FIG. 7.
Figure 10:
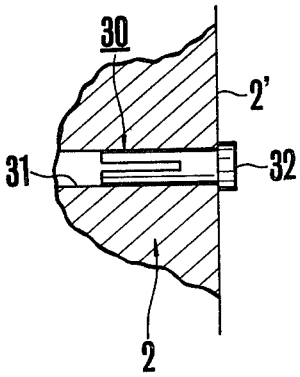
FIG. 10 is a fragmentary longitudinal sectional view showing the rotation preventing pin shown in FIG. 7.

As shown by the embodiment, when the gas operating device (not shown) is arranged separately from the cartridge magazine tube so as to be housed in the hollow portion (35) of the fore arm (29) as shown in FIG. 8 it is possible to engage the cartridge magazine tube (6) tightly with the fore-arm (29) and to make the abutting relationship between the arms (20), (21) and the gunbarrel (1) very tight, so tha the influence of the heat generated at the shooting of a cartridge onto the fore-arm (29) is made to the minimum.

The supporting mechanism for the gunbarrel of an automatic gun and the fore-arm thereof as described with reference to the embodiment thereof can serve to simultaneously prevent rotation of the gunbarrel and the forearm by virtue of the projection freely attachable to and detachable from the receiver, thereby permitting the construction of the mechanism to be simple in comparison with the prior art automatic gun of the conventional construction so that the machining operation is made simple and the manufacturing cost is lowered while the limitation in design of the fore-arm is widely relieved.

What is claimed is:

1. A gas operating device for loading a shot shell in an automatic gun comprising a receiver housing having a forward end surface facing in the direction in which the gun is fired, a breech block mounted in said receiver housing and being movably positionable therein between a locked position and a released position with the locked position being closer to the forward end surface than the released position, a gunbarrel secured to and projecting from the forward end surface of said receiver housing in the firing direction of the gun, an axially extending action bar mounted on the exterior of said gunbarrel and extending into said receiver housing in contact with said breech block in the locked position, said action bar arranged to be displaced by the gas pressure generated at the firing of a shot shell in the gun for displacing said breech block from the locked position into the released position, wherein the improvement comprises a cylinder mounted on the exterior of said gunbarrel and spaced forwardly of said receiver housing, said cylinder disposed in communication with said gunbarrel for receiving gas pressure therefrom when the shot shell is fired, a guide hole formed in the forward end surface of said receiver housing and extending therefrom to the locked position of said breech block, said action bar having a forward end positioned in said cylinder and a rearward end in said hole in contact with said breech block in the locked position, said action bar being axially movable so that the gas pressure in said cylinder moves said action bar in the rearward direction against said breech block for displacing said breech block into the released position, stop means are located on said action bar for limiting the rearward movement of said action bar into said receiving housing, said action bar comprises a first action bar and a second action bar in coaxial alignment with said first action bar, each of said first and second action bars having a first end and a second end, the first end of said first action bar is located in said cylinder, the second end of said second action bar is located in said receiver housing, the second end of said first action bar and the first end of said second action bar being movable relative to one another and spring means are mounted between said first and second action bars for transmitting the force of the gas pressure within said cylinder over said first and second action bars to said breech block.

2. A gas operating device, as set forth in claim 1, wherein said stop means comprises an outwardly projecting flange on said second action bar arranged to contact said forward end surface of said receiver housings for limiting the axial movement of said second action bar into said receiver housing.

* * * * *